United States Patent [19]

Gillotti

[11] 4,403,889

[45] Sep. 13, 1983

[54] GRADE CONTROL ALIGNMENT DEVICE AND METHOD

[76] Inventor: John A. Gillotti, 4103 SW. 34 St., Des Moines, Iowa 50315

[21] Appl. No.: 271,520

[22] Filed: Jun. 8, 1981

[51] Int. Cl.[3] ..... E01C 19/00; E01C 3/06

[52] U.S. Cl. ..... 404/72; 404/84; 172/430; 37/DIG. 19

[58] Field of Search ..... 404/72, 84, 98, 101, 404/104; 37/DIG. 14, DIG. 19; 172/430

[56] References Cited

U.S. PATENT DOCUMENTS

| | | | |
|---|---|---|---|
| 334,903 | 1/1886 | Senteney | 37/DIG. 19 |
| 546,653 | 9/1895 | Carruthers | 172/430 X |
| 1,395,810 | 11/1921 | George | 37/DIG. 19 |
| 1,609,734 | 12/1926 | Meyers | 172/430 |
| 1,782,992 | 11/1930 | Johnson | 37/DIG. 19 |
| 1,987,398 | 1/1935 | Gardiner | 404/101 |
| 2,503,408 | 4/1950 | Phillips | 37/DIG. 19 X |
| 3,041,754 | 7/1962 | Reynolds | 37/DIG. 14 X |
| 3,069,983 | 12/1962 | Pizzarotti et al. | 404/84 X |
| 3,158,945 | 12/1964 | Curlett et al. | 404/84 X |
| 3,177,785 | 4/1965 | MacDonald | 404/104 |
| 3,309,799 | 3/1967 | Kinkade | 172/430 X |
| 3,779,661 | 12/1973 | Godbersen | 404/72 |
| 3,813,181 | 5/1974 | Barnes | 404/84 |
| 4,101,237 | 7/1978 | Catenacci | 404/98 |

FOREIGN PATENT DOCUMENTS

| | | | |
|---|---|---|---|
| 549769 | 5/1932 | Fed. Rep. of Germany | 404/84 |
| 24522 | 2/1961 | German Democratic Rep. | 172/430 |

*Primary Examiner*—Nile C. Byers, Jr.
*Assistant Examiner*—Beverly E. Hjorth
*Attorney, Agent, or Firm*—Henderson & Sturm

[57] ABSTRACT

A grade control alignment device and method used in combination with a machine having an automatic grade control system to control the grade or elevation of a working implement. The alignment device is mounted on the machine and a sighting reference is visually aligned with a grade reference line which is set at a predetermined desired elevation. By periodically viewing the alignment device the operator determines if the automatic control is maintaining the working implement at the proper grade. If the proper grade is not being maintained, the operator overrides the automatic control to adjust the grade of the working implement.

8 Claims, 5 Drawing Figures

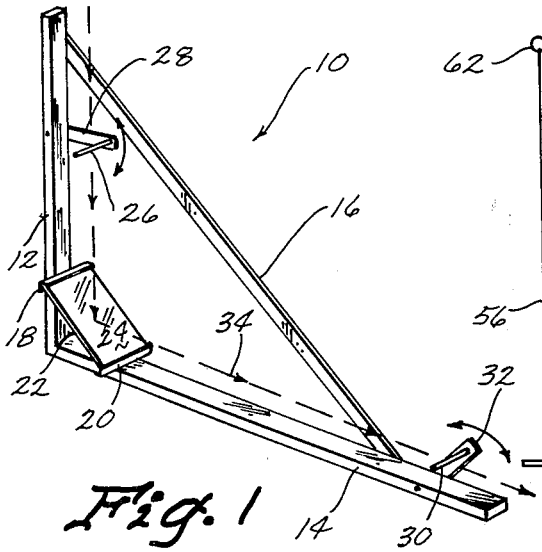
Fig. 1
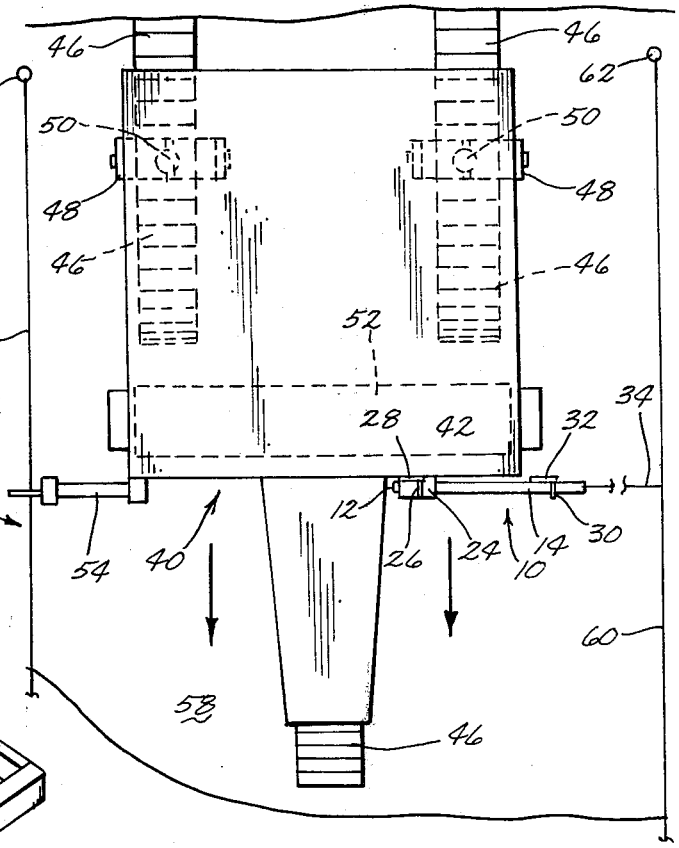
Fig. 2
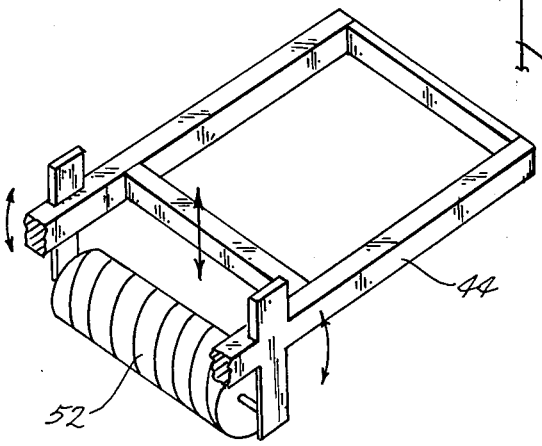
Fig. 3
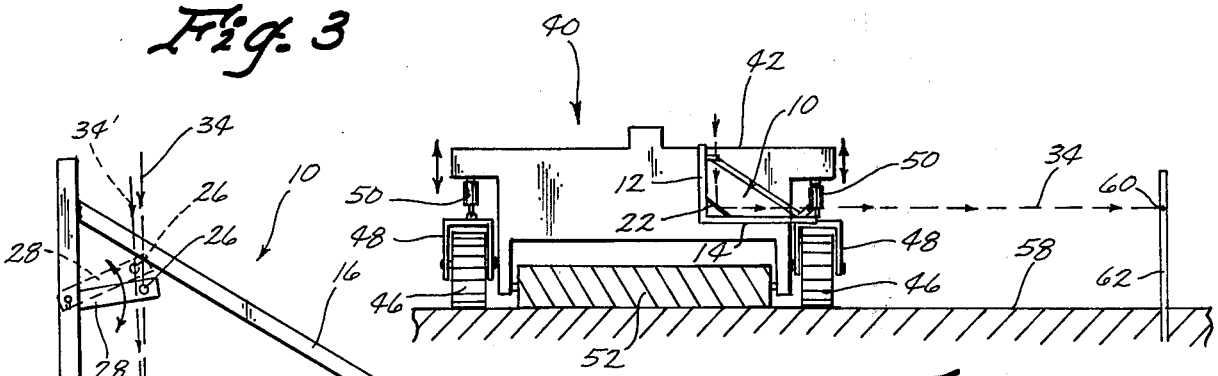
Fig. 5
Fig. 4

GRADE CONTROL ALIGNMENT DEVICE AND METHOD

BACKGROUND OF THE INVENTION

The present invention relates generally to a grade control alignment device and more particularly to a grade control alignment device used in combination with a machine having an automatic grade control system to control the grade or elevation of a working implement.

In the construction industry various machines are available which cut or fill material to a predetermined grade or elevation. These machines incorporate devices which automatically control the grade and slope of a working implement by contact of a sensor wand with a preset string line or grade reference line. One such machine for the simultaneous and continuous preparation of a graded surface and the slip forming of a concrete structure on the prepared surface is disclosed in U.S. Pat. No. 3,779,661.

One of the most critical problems associated with these machines having automatic grade controls, is the variation from the desired grade or elevation which is encountered in use. It is extremely important to minimize this variation where strict specifications must be adhered to. Variations from the required grade of a prepared surface or variations from the required grade of asphalt or concrete applied over a prepared surface, can result in an applied surface which is either too thick or too thin. If the applied surface is too thick, expensive materials are unnecessarily used; if the applied surface is too thin, minimum specifications will not be met. In order to insure that grade variations are minimized, contractors commonly have laborers follow behind the machines to manually check the grade with a string line and inform the machine operator of needed adjustments. This procedure is, likewise, economically wasteful. Those concerned with this problem recognize the need for an improved means and method for controlling the grade of a working implement.

SUMMARY OF THE INVENTION

A grade control alignment device and method is provided which is used in combination with a machine having an automatic grade control system which controls the grade or elevation of a working implement. The alignment device includes a sighting reference mounted on a support structure, which in turn is mounted on the machine. The alignment device is positioned to be conveniently viewed by the machine operator who initially aligns the sighting reference with a grade reference line and locks the alignment device in position. As the machine travels forward over the surface to be prepared, the operator refers to the alignment device to determine if the alignment, and thus the proper elevation of the working implement, is maintained. When the operator observes a variation from the desired grade, he overrides the automatic grade control and restores the working implement to the proper grade.

An object of the present invention is the provision of an improved structure and method for minimizing the grade variation of the working implement of a machine having an automatic grade control system.

Another object is to provide an alignment device which is simple in design and easy to maintain and use.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of one embodiment of the visual alignment device of the instant invention;

FIG. 2 is a top plan view of a machine including automatic grade control actuated by a sensor wand in contact with a first grade reference line, wherein the visual alignment device of the instant invention is directed toward a second grade reference line;

FIG. 3 is a cut-away perspective view showing a portion of the frame of the machine shown in FIG. 2, together with an augertype trimmer working implement;

FIG. 4 is a front elevational view of the visual alignment device of the instant invention where an alternate position of the sighting pins is shown in dashed lines, and the sight lines are indicated by arrows; and FIG. 5 is a front elevational view of the machine shown in FIG. 2 employing the visual alignment device directed toward a second grade reference line, wherein the visual alignment of the sight pins and the second grade reference line is illustrated by the sight line (arrows).

DESCRIPTION OF THE PREFERRED EMBODIMENTS

Referring now to the drawings, wherein like reference numerals designate identical or corresponding parts throughout the several views, FIG. 1 illustrates one embodiment of the visual alignment device 10, which includes a support structure having a first substantially vertical section 12 and a second substantially horizontal section 14 interconnected by brace 16. Angular brackets 18 and 20, attached to sections 12 and 14 respectively, secure a reflector plate 22 which includes a reflective surface 24. A first sight pin 26 is pivotally attached by arm 28 to the first section 12, and a second sight pin 30 is pivotally attached by arm 32 to the second section 14. The reflective surface 24 is disposed at an angle of about 45° and is directed toward both the first sight pin 26 and the second sight pin 30. Sight line (arrow) 34, or an alternate sight line (arrow) 34' (FIG. 4) indicates the visual alignment of the first and second sight pins 26 and 30, when viewed from above.

As shown most clearly in FIGS. 2 and 5, the alignment device 10, is rigidly mounted on the machine 40 such that it can be viewed by looking down from the operator's platform 42. The machine 40 includes a frame 44 adjustably supported at an elevation above the continuous track units 46. Each track unit 46 includes a yoke 48 and a vertically extending hydraulic cylinder 50 interconnects each yoke 48 to the frame 44. A working implement, an auger-type trimmer 52, is attached in fixed spaced relationship to the frame 44. When the cylinders 50 are extended or retracted by the automatic and/or manual override controls (not shown), the grade and slope of the frame 44—and thus the grade and slope of the trimmer 52—are adjusted.

FIG. 2 illustrates a machine 40 having an automatic grade control actuated by a sensor wand 54 which contacts a first grade reference line 56 disposed parallel to the direction of travel of the machine 40. As the machine 40 travels forward over the surface 58 the sensor wand 54 follows the first grade reference line 56 and automatically actuates the cylinders 50 to control the grade and slope of the frame 44, and thus the trimmer 52. FIG. 2 also shows the visual alignment device 10 directed toward a second grade reference line 60. The second grade reference line 60 is also disposed parallel to the direction of travel of the machine 40, but on the side opposite the first grade reference line 56. Both the first and second grade reference lines 56 and 60 are supported at a predetermined elevation by stakes 62.

It is to be understood that the visual alignment device 10 could be of many different embodiments not shown in the drawings, so long as the alignment device includes a sighting reference (such as first and second sight pins 26 and 30) and means for adjusting the alignment device 10 to visually align the sighting reference with a grade reference line (either first grade reference line 56 or second grade reference line 60). It is also to be understood that the means for adjusting the alignment device 10 could include a support structure adjustably attached to the machine 40, which support structure carries the sighting reference; in lieu of, or in combination with, the pivotally adjustable sighting reference shown. Also the working implement could be any of a number of implements used to cut or fill material to a predetermined grade or elavation.

In operation, the visual alignment device 10 is mounted on the machine 40 such that it will move together with the working implement or trimmer 52. The machine 40 is then positioned so that the sensor wand 54 contacts the first grade reference line 56 and the automatic grade control is actuated. From the operator's platform 42, the operator adjusts the sight pins 26 and 30 to visually align them with a grade reference line 60 (or 56). As the machine 40 moves forward over the surface 58 the operator periodically views the alignment device 10 to determine if the visual alignment of the sight pins 26 and 30 and the grade reference line 60 (or 56) is maintained. If the visual alignment is not maintained, the operator actuates the manual override to extend or retract the cylinders 50, thus adjusting the grade of the trimmer 52 and restoring the visual alignment. Employing the visual alignment device 10, the machine operator is able to minimize the variation of the elevation of the working implement from a predetermined desired elevation.

Obviously many modifications and variations of the present invention are possible in light of the above teachings. It is therefore to be understood that, within the scope of the appended claims, the invention may be practiced otherwise than as specifically described.

I claim:

1. In combination with a machine including means for automatically controlling the grade of a working implement of the machine as the machine travels over a surface and means for overriding said automatic grade control means, wherein the automatic grade control senses and is responsive to the relative position of the working implement with respect to a first grade reference line disposed on a first transverse side of the machine, said first grade reference line being disposed substantially parallel to the direction of travel of the machine, the improvement comprising:

a visual alignment device mounted on said machine, said alignment device including a sighting reference and means for adjusting said alignment device to visually align a grade reference line and said sighting reference, whereby a machine operator can refer to the alignment device and override the automatic grade control means as required to maintain the desired elevation of the working implement;

said sighting reference including a support structure attached to said machine, a first sight pin attached to said support, and a second sight pin attached to said support and spaced from said first sight pin, such that said first and second sight pins are angularly sighted and visually aligned with a grade reference line; and said support including a first section and a second section angularly disposed with respect to said first section, and wherein said first sight pin is attached to said first section and said second sight pin is attached to said second section.

2. The machine of claim 1, further including a reflection plate attached to said support and disposed between said first and second sight pins, such that a reflective surface of said reflection plate is directed toward both said first and second sight pins.

3. The machine of claim 2, wherein said support is pivotally attached to said machine.

4. The machine of claim 2, wherein said first sight pin is pivotally attached to said support.

5. The machine of claim 2, wherein said first and second sight pins are pivotally attached to said support.

6. A method for controlling the grade of a working implement of a machine, wherein said machine includes means for automatically controlling the grade of a working implement of the machine as the machine travels over a surface and means for overriding said automatic grade control means, wherein the automatic grade control senses and is responsive to the relative position of the working implement with respect to a first grade reference line disposed on a first transverse side of the machine, and said first grade reference line being disposed substantially parallel to the direction of travel of the machine, the method comprising the steps of:

mounting a visual alignment device on said machine, said alignment device including a sighting reference and means for adjusting said alignment device to visually align a grade reference line and said sighting reference; said sighting reference including a support structure attached to said machine, a first sight pin attached to said support, and a second sight pin attached to said support and spaced from said first sight pin, such that said first and second sight pins are angularly sighted and visually aligned with a grade reference line; and said support including a first section and a second section angularly disposed with respect to said first section, and wherein said first sight pin is attached to said first section and said second sight pin is attached to said second section;

actuating the automatic grade control;

adjusting said alignment device to visually align said grade reference line and said sighting reference;

periodically viewing the alignment device to determine if the visual alignment of the grade reference line and the sighting reference is maintained as the machine travels over a surface; and actuating said automatic grade control overriding means to adjust the grade of the working implement when said visual alignment is not maintained, to restore said visual alignment.

7. The method of claim 6, wherein said grade reference line is said first grade reference line.

8. The method of claim 6, wherein said grade reference line is a second grade reference line disposed on a second transverse side of said machine, said second grade reference line being disposed substantially parallel to the direction of travel of said machine.

* * * * *